US007023392B2

(12) United States Patent
Brown et al.

(10) Patent No.: US 7,023,392 B2
(45) Date of Patent: Apr. 4, 2006

(54) FLUID DIELECTRIC REFLECTARRAY

(75) Inventors: Stephen B. Brown, Palm Bay, FL (US); James J. Rawnick, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/640,148

(22) Filed: Aug. 13, 2003

(65) Prior Publication Data

US 2005/0035916 A1 Feb. 17, 2005

(51) Int. Cl.
*H01Q 3/00* (2006.01)

(52) U.S. Cl. ..... 343/757; 343/700 MS

(58) Field of Classification Search ..... 343/700 MS, 343/777, 778, 757; 342/368
See application file for complete search history.

(56) References Cited

U.S. PATENT DOCUMENTS

| | | | | | |
|---|---|---|---|---|---|
| 4,684,952 | A | | 8/1987 | Munson et al. | 343/700 MS |
| 5,162,972 | A | | 11/1992 | Gripshover et al. | 361/277 |
| 5,276,455 | A | * | 1/1994 | Fitzsimmons et al. | 343/777 |
| 5,488,380 | A | * | 1/1996 | Harvey et al. | 342/368 |
| 5,680,142 | A | * | 10/1997 | Smith et al. | 342/372 |
| 6,515,235 | B1 | | 2/2003 | Moller | 174/256 |
| 2002/0093396 | A1 | * | 7/2002 | Smith | 333/157 |

OTHER PUBLICATIONS

U.S. Appl. No. 10/369,436, filed Feb. 18, 2003, Rawnick et al.
U.S. Appl. No. 10/387,208, filed Mar. 11, 2003, Rawnick et al.
U.S. Appl. No. 10/330,755, filed Dec. 27, 2002, Rawnick et al.
U.S. Appl. No. 10/330,754, filed Dec. 27, 2002, Rawnick et al.
U.S. Appl. No. 10/300,456, filed Nov. 19, 2002, Rawnick et al.
U.S. Appl. No. 10/361,548, filed Feb. 10, 2003, Rawnick et al.
U.S. Appl. No. 10/387,209, filed Mar. 11, 2003, Rawnick et al.
U.S. Appl. No. 10/387,194, filed Mar. 11, 2003, Brown et al.
U.S. Appl. No. 10/438,435, filed May 15, 2003, Brown et al.
U.S. Appl. No. 10/414,696, filed Apr. 16, 2003, Brown et al.
U.S. Appl. No. 10/637,027, filed Aug. 7, 2003, Brown et al.
U.S. Appl. No. 10/414,650, filed Apr. 16, 2003, Brown et al.
U.S. Appl. No.10/635,629, filed Aug. 6, 2003, Brown et al.
U.S. Appl. No. 10/459,067, filed Jun. 11, 2003, Brown et al.
U.S. Appl. No. 10/438,436, filed May 15, 2003, Rawnick et al.
U.S. Appl. No. 10/626,090, filed Jul. 24, 2003, Brown et al.
U.S. Appl. No. 10/635,582, filed Aug. 6, 2003, Rawnick et al.

(Continued)

*Primary Examiner*—Tuyet Vo
*Assistant Examiner*—Jimmy Vu
(74) *Attorney, Agent, or Firm*—Sacco & Associates, PA

(57) ABSTRACT

An antenna can comprise a conductive reflecting surface (204) and a plurality of cells (202) disposed over the conductive reflecting surface. The plurality of cells can be formed from a solid dielectric material such as a low temperature cofired ceramic. Each cell can define a cavity for containing at least a fluid dielectric (406). One or more fluid processors (404, 424) independently vary a volume of the first fluid dielectric in the plurality of cells for producing a redirected RF beam at a selected angle relative to an incident RF signal impinging on the conductive reflecting surface.

22 Claims, 4 Drawing Sheets

OTHER PUBLICATIONS

U.S. Appl. No. 10/632,632, filed Aug. 1, 2003, Rawnick et al.
U.S. Appl. No. 10/614,149, filed Jul. 7, 2003, Brown et al.
U.S. Appl. No. 10/634,219, filed Aug. 5, 2003, Rawnick et al.
U.S. Appl. No. 10/458,859, filed Jun. 11, 2003, Rawnick et al.
U.S. Appl. No. 10/624,378, filed Jul. 22, 2003, Brown et al.
U.S. Appl. No. 10/438,433, filed May 15, 2003, Rawnick et al.
U.S. Appl. No. 10/460,947, filed Jun. 13, 2003, Rawnick et al.
U.S. Appl. No. 10/421,352, filed Apr. 23, 2003, Rawnick et al.
U.S. Appl. No. 10/409,261, filed Apr. 8, 2003, Pike.
U.S. Appl. No. 10/441,743, filed May 19, 2003, Pike.
U.S. Appl. No. 10/628,846, filed Jul. 28, 2003, Pike et al.
U.S. Appl. No. 10/300,455, filed Nov. 19, 2002, Brown et al.
U.S. Appl. No. 10/637,409 filed Aug. 8, 2003, Brown et al.
U.S. Appl. No. 10/640,237, filed Aug. 13, 2003, Rawnick et al.

* cited by examiner

FLUID DIELECTRIC REFLECTARRAY

BACKGROUND OF THE INVENTION

1. Statement of the Technical Field

The inventive arrangements relate generally to methods and apparatus for steerable beam antennas, and more particularly to controlled dielectric surfaces over a reflecting surface that can be used for steering antenna beams.

2. Description of the Related Art

The basic concept of a reflectarray is to change the direction of a beam emitted from an antenna. The notion is not specific to any particular type of antenna, but has the highest utility for antennas with some significant intrinsic directivity, such as reflectors, horns, helices, or Yagi-Uda style arrays. Reflectarrays add an extra structure to a fixed-beam antenna to allow the system to have a steerable beam. It will be appreciated that common reflect-array antennas are reciprocal in their operation. If the system will steer a transmitted beam, it will also steer the receive beam in a similar way.

There are several ways to make reflective structures perform a beam steering function. A simple flat conducting plate can be used to perform beam steering by moving the orientation of the reflector plate. The same effect can be achieved using a flat conductive plate covered by a dielectric. However, it is often desirable to steer the beam without the need for gross mechanical movement of the reflector plate. Conventional reflectarrays can perform this function electronically.

A reflectarray is commonly comprised of an array of resonantly-dimensioned microstrip antenna radiator patches that are closely spaced above a ground plane type reflecting surface. Conventional electronic phase shifters can be provided for shifting the phase of an incident RF signal received by each antenna radiator patch and then retransmitting the signal, usually via the same antenna radiator patch. For example, diode switches can be used to control a transmission line structure to vary a phase shift. The phase shifts of the individual resonators create a phased array effect that can be controlled to determine the direction of a redirected beam of RF energy. One example of a reflectarray is disclosed in U.S. Pat. No. 4,684,952 to Munson et al. However, alternative arrangements are also known in the art.

SUMMARY OF THE INVENTION

The invention concerns a method for steering an antenna beam, including the steps of reflecting an electromagnetic signal using a conductive reflecting surface and controlling a direction of a reflected beam produced by the conductive reflecting surface. The reflected beam is controlled by selectively varying a volume of a first fluid dielectric contained in a plurality of independently controlled cells disposed over the conductive reflecting surface. The step of selectively varying the volume can include controlling at least one pump. According to one embodiment, the method can include the step of linearly tapering a volume of the first fluid dielectric contained in the plurality of cells in at least one direction defined along a reflecting surface of the conductive reflecting surface.

The step of selectively controlling a volume of the first fluid dielectric can displace a gas or a second fluid dielectric that can also be contained within each cell. If a second fluid dielectric is used, the second fluid dielectric can be selected to be immiscible with the first fluid dielectric.

According to another aspect, the invention can include a steerable beam antenna. The steerable beam antenna can comprise a conductive reflecting surface and a plurality of cells disposed over the conductive reflecting surface. The plurality of cells can be formed from a solid dielectric material such as a low temperature cofired ceramic. Each cell can define a cavity for containing at least a first fluid dielectric.

One or more fluid processors independently vary a volume of the first fluid dielectric in the plurality of cells for producing a redirected RF beam at a selected angle relative to an incident RF signal impinging on the conductive reflecting surface. For example, the fluid processor can include a controller and at least one pump for controlling a volume of the first fluid dielectric in each cell cavity. Further, the first fluid dielectric can displace a gas in the cavity or a second fluid dielectric in the cavity. If a second fluid dielectric is used, then the first and second fluid dielectrics are preferably immiscible so that an immiscible fluid interface separates them.

DETAILED DESCRIPTION OF THE PREFERRED EMBODIMENTS

Figure 1A:
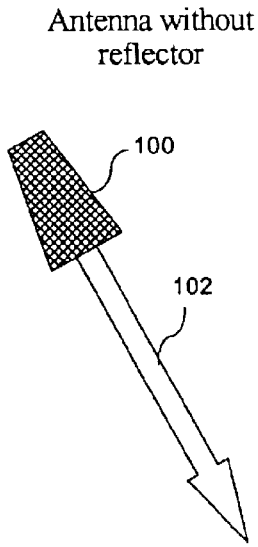
FIGS. 1A and 1B are conceptual drawing that are useful for demonstrating the theory of operation of the present invention.
Figure 1B:
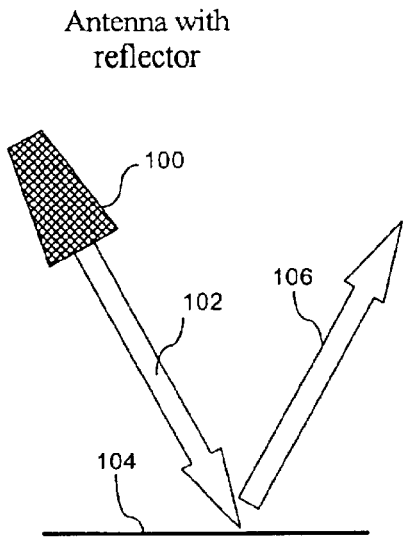

FIGS. 1A and 1B are conceptual drawings that are useful for understanding the basic operation of reflectarrays, including the present invention. In FIG. 1A, an antenna 100 is illustrated together with a ray 102 representing a transmission direction of an electromagnetic wave. In FIG. 1*b*, a reflector 104 is added to the system, which results in a reflected ray 106. The reflector, which can be a conductive ground plane, changes the direction of the incident beam as shown. The arrangement in FIG. 1*b* is a static configuration. To make beam in FIG. 1*b* steerable, it is necessary to have some way of altering the properties of the reflector 104. Note that although the figure shows the direction of the ray as emitted from the antenna, i.e., the transmitting case, the principle (and the invention described herein) applies equally well to the receiving case.

Figure 2:
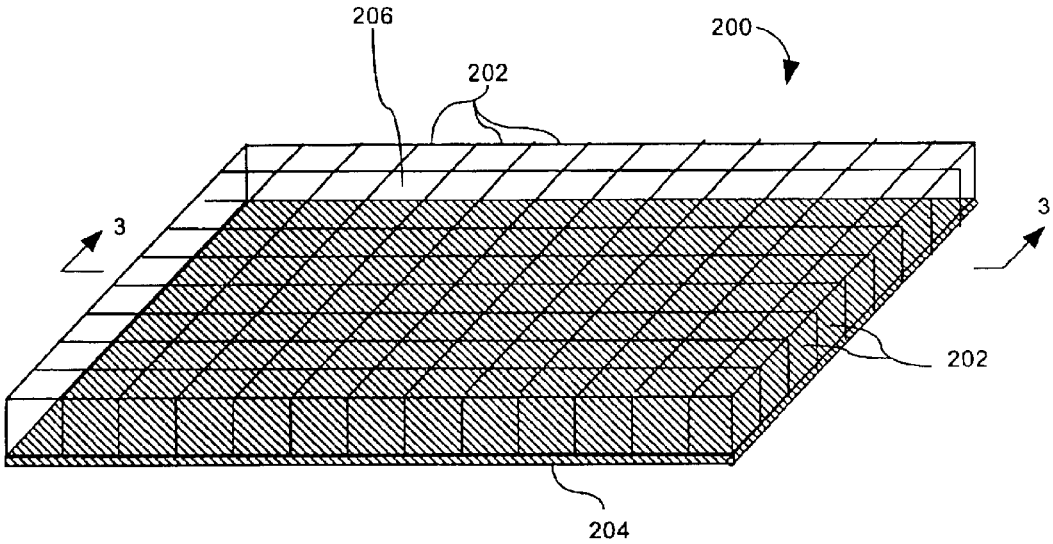
FIG. 2 is a perspective view of a steerable beam reflector that is useful for understanding the invention.
Figure 3:
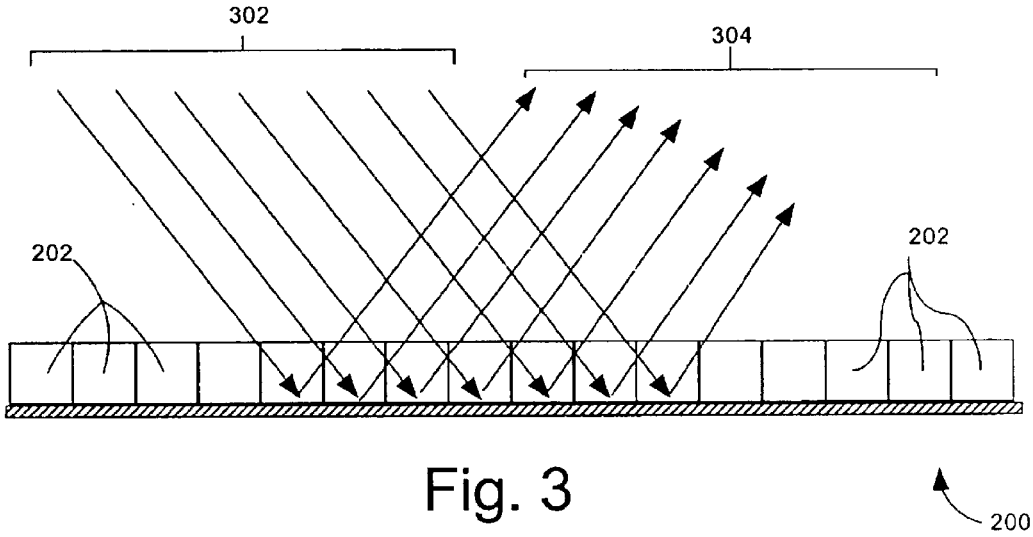
FIG. 3 is a cross-section view of the reflector of FIG. 2 taken along line 3—3.

The present invention controls the electrical characteristics of a dielectric layer disposed over the reflector surface to perform beam steering. As shown in FIG. 2, a reflector 200 consists of numerous discrete dielectric cells 202 arranged in a lattice or matrix over a conductive reflecting surface 204. Each cell 202 defines a cavity that can contain a selected volume of fluid dielectric. As illustrated in FIG. 3, incident rays 302 and reflected rays 304 are delayed or phase shifted as they pass through the dielectric contained in each of the cells 202. To produce this phase shift effect, the dielectric preferably has a relative permittivity greater than one so as to produce a propagation velocity that is lower than that of free space.

The volume of fluid in each cell 202 can be selectively varied to control the amount of phase shift that occurs in each cell. If this variance is linear across the surface of reflector structure 200, the reflected beam will be steered in proportion to the magnitude of the change in dielectric constant from cell to cell. More particularly, since each portion of the wavefront is delayed by a different amount, the net effect is to tilt the wavefront. In FIG. 3, each ray path shown is represented for equal time. Paths with less delay are illustrated by longer rays that cover more distance in the same amount of time. Additional detail regarding conventional beam steering methods using similar techniques are described in U.S. Pat. No. 4,684,952 to Munson et al., the disclosure of which is expressly incorporated herein by reference.

Further, by varying the volume of fluid dielectric in accordance with other patterns, it is possible to vary the shape of the reflected beam. For example, by decreasing the amount of fluid dielectric contained in each cell in a radial direction away from the center of the surface 206, the reflector can electrically appear to have a curved surface.

For convenience, the reflector structures shown in the figures are flat. However, it should be appreciated that the invention is not so limited. For example, the invention can also be used in connection with curved surface reflectors. A curved surface will modify beam shape as well as direction, and curved reflectors are more often used for beam shaping as opposed to beam steering. However, those skilled in the art will readily appreciate that the concepts disclosed herein have applicability to both types of reflector surfaces.

Figure 4:
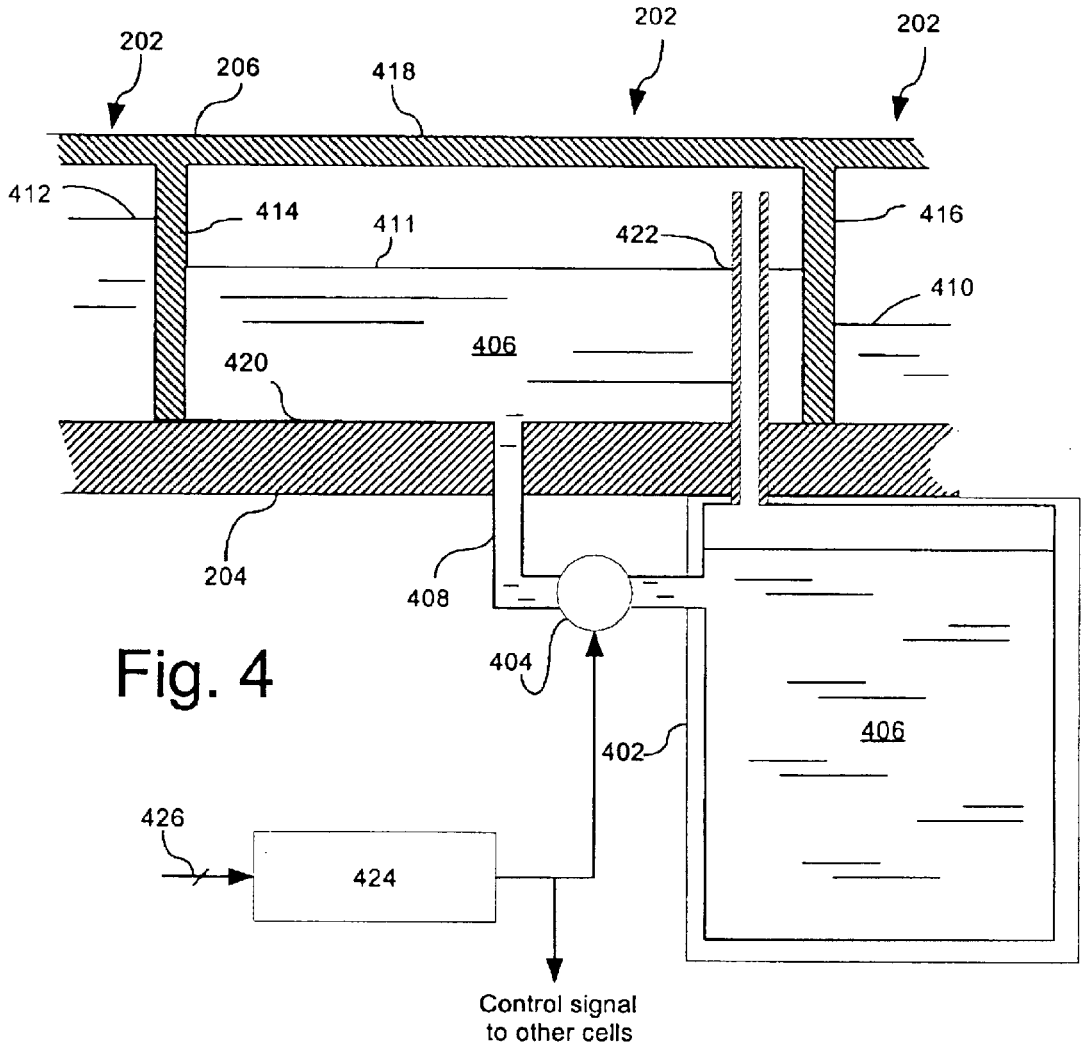
FIG. 4 is an enlarged cross-sectional view of a single exemplary cell.

Referring now to FIG. 4, there is shown an enlarged cross-sectional view of a cell 202 that is useful for understanding the invention. It should be noted however that the invention is not limited to the precise arrangements shown in FIG. 4. Instead, FIG. 4 should be understood to represent merely one possible way in which a fluid dielectric can be moved into and out of the cell 202.

As shown in FIG. 4, the cell can be bounded by a solid dielectric structure including dielectric walls 414, 416, 418. Conductive reflecting surface 204 can be used to form a bottom of the cell 202. Alternatively, a further dielectric layer can be optionally provided on surface 420 to isolate the fluid dielectric 406 from the conductive reflecting surface 204. The dielectric walls can be formed of any suitable dielectric material such as plastic or a low temperature cofired ceramic (LTCC) material. The relative permittivity of such material is generally not critical. According to a preferred embodiment, a uniform dielectric material can be used to form the cell structure so that the phase shift introduced by the dielectric walls 414, 416, 418 will be uniform across the surface 206 of the reflector structure 200. However, the invention is not limited in this regard and there may be instances in which it can be desirable to form the cell walls from dielectric materials having relatively different values of permittivity.

A fluid reservoir 402 can be provided for storing a quantity of fluid dielectric 406. In FIG. 4, a single reservoir is shown serving a single cell 202. However, it should be understood that the reservoir 402 can also be configured to provide fluid dielectric 406 to a plurality of cells 202. For example a single reservoir could service all of the cells 202 that form the reflector 200.

According to one embodiment, at least one pump 404 can be provided for adding and removing fluid dielectric 406 from the cell 202. Different levels 410, 411, 412 of fluid dielectric can be selectively provided for each cell 202. In FIG. 4, the fluid dielectric can be communicated from the pump 404 to the interior of the cell 202 through a suitable conduit 408. The pump 404 can be a conventional miniature fluid pump or can a micro electro-mechanical machine (MEMS) type arrangement. A pressure relief path 422 can be provided for equalizing the pressure inside the cell 202 as the volume of fluid dielectric within the cell 202 is increased or decreased. Still, those skilled in the art will readily appreciate that there are many ways that a controlled volume of fluid can be moved into and out of each cell 202, and the invention is not intended to be limited to any one particular arrangement. Instead, any combination of pumps, reservoirs, conduits and valves can be used for this purpose, provided that the volume of fluid in each cell can be independently controlled.

A controller 424 can also be provided for controlling the volume of fluid contained in each cell 202. The controller can be comprised of a microprocessor, a look-up-table, and any other circuitry that may be required for independently adjusting the volume of fluid dielectric in each cell in response to a beam steering signal. For example, the controller can cause pump 404 to add or remove fluid dielectric 406 from each cell 202 as may be needed to steer a beam in a particular direction. In this regard, the controller is preferably provided with stored data or processing capability sufficient to determine the volume of fluid in each cell 202 that is necessary for reflecting the RF beam in a particular direction indicated by a control signal. It will be appreciated by those skilled in the art that there are many other equally effective alternative arrangements that can be adopted for independently controlling the volume of fluid dielectric that is contained in the cell 202, and the invention is intended to encompass all such arrangements.

Two critical factors affecting the performance of the fluid dielectric are permittivity (sometimes called the relative permittivity or $\in_r$) and permeability (sometimes referred to as relative permeability or $\mu_r$). The permittivity and permeability determine the propagation velocity of a signal, which is approximately inversely proportional to $\sqrt{\mu\in}$. Accordingly, the amount of phase shift produced by the fluid dielectric will be substantially determined by the relative permittivity and relative permeability of the fluid dielectric 406.

It may be noted that reflections can occur at the surface of dielectric wall 418 and at the surface of fluid dielectric 406. These reflections can be minimized by maintaining a ratio of permeability to permittivity that is approximately equal to the ratio of these values in free space. Thus, the ratio of permittivity to permeability can be advantageously selected to match free space and thereby minimize reflections occurring at the surface of the fluid dielectric.

The portion of the cell 202 not filled with fluid dielectric 406 can be filled with an inert gas. This gas can be displaced by the increasing or decreasing volume of fluid dielectric 406 within the cell. Alternatively, the space within the cell not occupied by the fluid dielectric 406 can be occupied by a second fluid dielectric that is immiscible with the first fluid dielectric and has a different relative permittivity. For example a water based dielectric and an oil based dielectric would be immiscible and could be used for this purpose.

Composition of the Fluidic Dielectric

The fluidic dielectric as described herein can be comprised of any fluid composition having the required characteristics of permittivity and permeability as may be necessary for achieving a selected range of phase shift. Those skilled in the art will recognize that one or more component parts can be mixed together to produce a desired permeability and permittivity required for a particular phase shift and characteristic impedance.

The fluidic dielectric 146 also preferably has a relatively low loss tangent to minimize the amount of RF energy lost in each cell 202. However, devices with higher loss may be acceptable in some instances so this may not be a critical factor. Many applications also require a broadband response. Accordingly, it may be desirable in many instances to select fluidic dielectrics 406 to have a relatively constant response over a broad range of frequencies.

Aside from the foregoing constraints, there are relatively few limits on the range of materials that can be used to form the fluidic dielectric. Accordingly, those skilled in the art will recognize that the examples of suitable fluidic dielectrics as shall be disclosed herein are merely by way of example and are not intended to limit in any way the scope of the invention. Also, while component materials can be mixed in order to produce the fluidic dielectric as described herein, it should be noted that the invention is not so limited. Instead, the composition of the fluidic dielectric could be formed in other ways. All such techniques will be understood to be included within the scope of the invention.

Those skilled in the art will recognize that a nominal value of permittivity ($\in_r$) for fluids is approximately 2.0. However, the fluidic dielectric used herein can include fluids with higher values of permittivity. For example, the fluidic dielectric material could be selected to have a permittivity values of between 2.0 and about 58, depending upon the amount of phase shift required.

Similarly, the fluidic dielectric can have a wide range of permeability values. High levels of magnetic permeability are commonly observed in magnetic metals such as Fe and Co. For example, solid alloys of these materials can exhibit levels of $\mu_r$ in excess of one thousand. By comparison, the permeability of fluids is nominally about 1.0 and they generally do not exhibit high levels of permeability. However, high permeability can be achieved in a fluid by introducing metal particles/elements to the fluid. For example typical magnetic fluids comprise suspensions of ferro-magnetic particles in a conventional industrial solvent such as water, toluene, mineral oil, silicone, and so on. Other types of magnetic particles include metallic salts, organometallic compounds, and other derivatives, although Fe and Co particles are most common. The size of the magnetic particles found in such systems is known to vary to some extent. However, particles sizes in the range of 1 nm to 20 μm are common. The composition of particles can be selected as necessary to achieve the required permeability in the final fluidic dielectric. Magnetic fluid compositions are typically between about 50% to 90% particles by weight. Increasing the number of particles will generally increase the permeability.

More particularly, a hydrocarbon dielectric oil such as Vacuum Pump Oil MSDS-12602 could be used to realize a low permittivity, low permeability fluid, low electrical loss fluid. A low permittivity, high permeability fluid may be realized by mixing same hydrocarbon fluid with magnetic particles such as magnetite manufactured by Ferro Tec Corporation of Nashua, N.H., or iron-nickel metal powders manufactured by Lord Corporation of Cary, N.C. for use in ferrofluids and magnetoresrictive (MR) fluids. Additional ingredients such as surfactants may be included to promote uniform dispersion of the particle. Fluids containing electrically conductive magnetic particles require a mix ratio low enough to ensure that no electrical path can be created in the mixture. Solvents such as formamide inherently posses a relatively high permittivity.

Similar techniques could be used to produce fluidic dielectrics with higher permittivity. For example, fluid permittivity could be increased by adding high permittivity powders such as barium titanate manufactured by Ferro Corporation of Cleveland, Ohio. For broadband applications, the fluids would not have significant resonances over the frequency band of interest.

RF Unit Structure, Materials and Fabrication

According to one aspect of the invention, the dielectric structure defining walls 414, 416, 418 of cells 202 can be formed from a ceramic material. For example, the dielectric structure can be formed from a low temperature co-fired ceramic (LTCC). Processing and fabrication of RF circuits on LTCC is well known to those skilled in the art. LTCC is particularly well suited for the present application because of its compatibility and resistance to attack from a wide range of fluids. The material also has superior properties of wetability and absorption as compared to other types of solid dielectric material. These factors, plus LTCC's proven suitability for manufacturing miniaturized RF circuits, make it a natural choice for use in the present invention.

Beam Control Process

Figure 5:
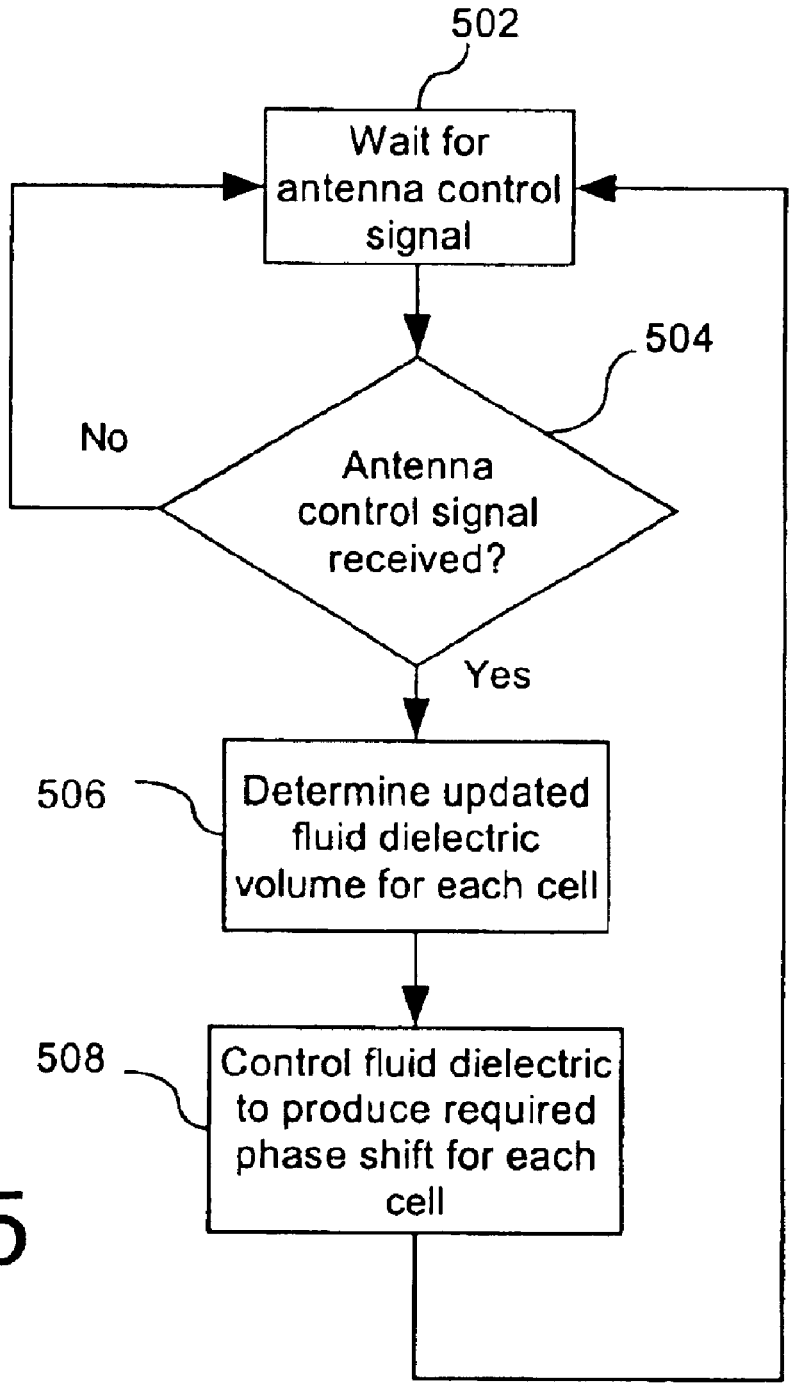
FIG. 5 is flow chart that is useful for understanding a process for controlling an antenna beam.

Referring now to FIG. 5, a process shall be described for controlling the angle of a redirected RF beam using the reflector structure 200. In step 502 and 504, controller 424 can wait for an antenna control signal 426 indicating a requested angle for a redirected beam. Once this information has been received, the controller 424 can calculate in step 506 a required phase shift for each cell 202 and a required volume of fluid dielectric 406 that is needed within each cell in order to produce the required phase shift. In step 508, the controller 424 can selectively control pump(s) 404 associated with each cell 202 to increase or decrease the fluid volume to produce the required phase shift.

As an alternative to calculating the required volume of the fluid dielectric in each cell, the controller 424 could also make use of a look-up-table (LUT). The LUT can contain cross-reference information for determining control data for each cell 202 necessary to achieve various reflected beam angles. For example, a calibration process could be used to identify the specific digital control signal values communicated from controller 424 to each pump 404 that is necessary to achieve a specific angle for the redirected beam. These digital control signal values could then be stored in the LUT. Thereafter, when control signal 426 is updated, the controller can immediately obtain the corresponding digital control signal for producing the required beam.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A method for steering an antenna beam, comprising the steps of:

reflecting an electromagnetic signal using a conductive reflecting surface; and controlling a direction of a reflected beam produced by said conductive reflecting surface by selectively varying a volume of a first fluid dielectric contained in a plurality of independently controlled cells disposed over said conductive reflecting surface.

2. The method according to claim 1 wherein said step of selectively varying said volume includes controlling at least one pump.

3. The method according to claim 1 further comprising the step of linearly tapering a volume of said first fluid dielectric contained in said plurality of cells in at least one direction defined along said reflecting surface.

4. The method according to claim 1 further comprising the step of arranging said plurality of cells to form a lattice.

5. The method according to claim 1 further comprising the step of forming said plurality of cells from a solid dielectric.

6. The method according to claim 1 further comprising the step of displacing a gas with said first fluid dielectric.

7. The method according to claim 1 further comprising the step of displacing a second fluid dielectric with said first fluid dielectric.

8. The method according to claim 7 further comprising the step of selecting said second fluid dielectric to be immiscible with said first fluid dielectric.

9. The method according to claim 1 further comprising the step of selecting said conductive reflecting surface to have a planar reflecting surface.

10. The method according to claim 1 further comprising the step of selecting said conductive reflecting surface to have a curved reflecting surface.

11. The method according to claim 1 further comprising the step of controlling a volume of said first fluid dielectric in said plurality of cells to control a shape of said reflected beam.

12. A steerable beam antenna comprising:

a conductive reflecting surface;

a plurality of cells disposed over said conductive reflecting surface, each cell defining a cavity for containing at least a first fluid dielectric;

at least one fluid processor independently varying a volume of said first fluid dielectric in said plurality of cells for producing a redirected RF beam at a selected angle relative to an incident RF signal impinging on said conductive reflecting surface.

13. The steerable beam antenna according to claim 12 wherein said fluid processor comprises a controller and at least one pump for controlling a volume of said first fluid dielectric in said cavity.

14. The steerable beam antenna according to claim 12 wherein said first fluid dielectric displaces a gas in said cavity.

15. The steerable beam antenna according to claim 12 wherein said first fluid dielectric displaces a second fluid dielectric in said cavity.

16. The steerable beam antenna according to claim 15 wherein said first and second fluid dielectrics are immiscible.

17. The steerable beam antenna according to claim 16 wherein an immiscible fluid interface separates the first and second fluid dielectrics.

18. The steerable beam antenna according to claim 12 wherein said plurality of cells are formed from a solid dielectric material.

19. The steerable beam antenna according to claim 18 wherein said solid dielectric material is a low temperature cofired ceramic.

20. The steerable beam antenna according to claim 12 wherein said conductive reflecting surface defines a planar reflecting surface.

21. The steerable beam antenna according to claim 20 wherein said conductive reflecting surface has a curved reflecting surface.

22. The steerable beam antenna according to claim 12 wherein said fluid processor controls a volume of said first fluid dielectric in said plurality of cells to control a shape of said reflected beam.

* * * * *